US007793442B2

(12) United States Patent
Koch et al.

(10) Patent No.: US 7,793,442 B2
(45) Date of Patent: Sep. 14, 2010

(54) AVOIDANCE SYSTEM FOR LOCATING ELECTRIC CABLES

(75) Inventors: Roger Dale Koch, Pekin, IL (US); Bryan James Everett, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 74 days.

(21) Appl. No.: 12/149,233

(22) Filed: Apr. 29, 2008

(65) Prior Publication Data

US 2009/0265962 A1 Oct. 29, 2009

(51) Int. Cl.
*G01D 5/00* (2006.01)

(52) U.S. Cl. ..... 37/413; 701/50; 701/210

(58) Field of Classification Search ..... 37/413, 37/348, 414, 382; 172/5, 6; 701/50, 25, 701/26, 209, 210
See application file for complete search history.

(56) References Cited

U.S. PATENT DOCUMENTS 429,104 A 5/1890 Witthaus
2,471,312 A 4/1948 Corbliss
2,483,050 A 9/1949 Hinchon
3,533,483 A * 10/1970 Ballinger ..... 180/9.38
3,695,377 A * 10/1972 Ito et al. ..... 180/315
3,863,741 A * 2/1975 Mitsuishi et al. ..... 191/12.2 A
3,943,306 A * 3/1976 Aihara et al. ..... 191/12.2 R
4,071,124 A * 1/1978 Price ..... 191/12 R
4,108,264 A * 8/1978 Tanaka ..... 180/2.1
4,119,908 A 10/1978 Cosman et al.
4,260,191 A 4/1981 Weber
4,423,852 A * 1/1984 Conroy et al. ..... 254/264
4,511,100 A * 4/1985 Oetringhaus ..... 242/390.6
4,587,383 A * 5/1986 Stoldt ..... 191/12 R
4,862,088 A 8/1989 Etienne et al.
5,028,149 A 7/1991 Hardtke
5,170,352 A 12/1992 McTamaney et al.
5,299,130 A 3/1994 Ono
5,361,756 A 11/1994 Cernosek et al.
5,587,929 A * 12/1996 League et al. ..... 342/159
5,612,883 A * 3/1997 Shaffer et al. ..... 701/300
5,646,845 A * 7/1997 Gudat et al. ..... 701/41
5,740,994 A 4/1998 Laughlin
5,779,198 A 7/1998 Rutherford et al.
5,822,891 A 10/1998 Fujishima et al.
5,928,309 A 7/1999 Korver et al.
6,058,344 A 5/2000 Rowe et al.
6,064,926 A * 5/2000 Sarangapani et al. ..... 701/26
6,271,667 B1 * 8/2001 Minarovic ..... 324/326
6,336,051 B1 1/2002 Pangels et al.

(Continued)

OTHER PUBLICATIONS

U.S. Appl. No. 12/603,293, filed Oct. 21, 2009 (25 pages).

(Continued)

*Primary Examiner*—Thomas A Beach
*Assistant Examiner*—Matthew R Buck
(74) *Attorney, Agent, or Firm*—Finnegan, Henderson, Farabow, Garrett & Dunner

(57) ABSTRACT

An avoidance system for a mobile earthmoving machine is disclosed. The avoidance system includes a sensor system configured to periodically detect a position of a cable tethered from the machine within a worksite and generate a position data set in response thereto. A controller is associated with the sensor system and configured to determine a cable avoidance region based on the position data set.

24 Claims, 7 Drawing Sheets

U.S. PATENT DOCUMENTS

| | | | | |
|---|---|---|---|---|
| 6,361,000 | B1 | 3/2002 | Jette | |
| 6,363,632 | B1 * | 4/2002 | Stentz et al. | 37/414 |
| 6,557,943 | B2 * | 5/2003 | Ando | 297/463.1 |
| 6,595,464 | B2 * | 7/2003 | Peck | 242/615.2 |
| 6,612,516 | B1 * | 9/2003 | Haines | 242/397.1 |
| 6,678,394 | B1 | 1/2004 | Nichani | |
| 6,711,838 | B2 | 3/2004 | Staub et al. | |
| 7,007,899 | B1 | 3/2006 | Bachman | |
| 7,009,399 | B2 | 3/2006 | Olsson et al. | |
| 7,010,425 | B2 | 3/2006 | Gray et al. | |
| 7,092,075 | B2 | 8/2006 | Singh et al. | |
| 7,181,370 | B2 | 2/2007 | Furem et al. | |
| 7,272,474 | B1 | 9/2007 | Stentz et al. | |
| 2004/0210370 | A1 * | 10/2004 | Gudat et al. | 701/50 |
| 2006/0085118 | A1 | 4/2006 | Baldwin | |
| 2006/0232427 | A1 | 10/2006 | Minarovic | |
| 2007/0150149 | A1 | 6/2007 | Peterson et al. | |

OTHER PUBLICATIONS

U.S. Appl. No. 12/149,234, filed Apr. 29, 2008 (18 pages).

* cited by examiner

AVOIDANCE SYSTEM FOR LOCATING ELECTRIC CABLES

TECHNICAL FIELD

The present disclosure is directed to an avoidance system, and more particularly, an avoidance system for detecting and locating electric cables.

BACKGROUND

Earthmoving machines such as excavation-type machines, drilling machines, loaders, and the like may be employed for mining or other earthmoving operations. These machines employ large earthmoving, excavating, or drilling equipment, such as electric mining shovels, configured to dig and load earthen material from a worksite, such as an open-pit mine, to large off-road haulage units, such as off-highway trucks which may be autonomously or semi-autonomously controlled. The shovel may be electrically powered and receive power from large, high-voltage cables tethered to the rear of the machine. The electric cables may lie across the ground of the worksite or along a bench floor during operation of the shovel. As the shovel moves to a new location, for example, when the shovel swings between a work surface and an off-highway truck that it is loading, the cables are dragged across the ground and their location changes relative to the ground.

Off-highway trucks may navigate to and from the shovel location to transport the earthen material from the worksite. An operator of the off-highway truck must avoid contact with the electric cables so as to prevent damage to both the electric cables and the truck. However, mobility and navigation around the electric cables may be difficult because the operator may be unable to see the ground, and thus locate the electric cables, near the truck.

One method of locating obstacles for mining operations under such conditions is described in U.S. Pat. No. 6,064,926 (the '926 patent) to Sarangapani et al., issued on May 16, 2000. The '926 patent describes a method and an apparatus for planning an alternate path in response to detection of an obstacle by a mobile machine, such as an off-road mining truck, at a worksite. The method includes determining the presence and location of an obstacle in a primary path of the mobile machine, determining an alternate path around the obstacle, and delivering a signal to a fleet manager with the location of the obstacle and the alternate path. The apparatus includes an obstacle detection system, a position determining system, a path planner, a communications system, and a control system to receive signals from the obstacle detection system, wherein the positions determining system, the path planner, and the communications system deliver a signal to the fleet manager with the location of the obstacle and the alternate path.

Although the method and the apparatus of the '926 patent may provide detection and evasion of obstacles under mining conditions, it may have limitations. For example, it may be difficult to accurately detect a location of a moving obstacle, such as electric cables tethered to the rear of an earthmoving machine.

The avoidance system of the present disclosure is directed towards improvements to the existing technology.

SUMMARY OF THE DISCLOSURE

One aspect of the present disclosure is directed to an avoidance system configured to track a cable tethered from a mobile earthmoving machine along a worksite during operation. The avoidance system may include a sensor system configured to periodically detect a position of the cable within the worksite and generate a position data set in response thereto. A controller may be associated with the sensor system and configured to determine a cable avoidance region based on the position data set.

Another aspect of the present disclosure is directed to a method for tracking a cable tethered from a mobile earthmoving machine along a worksite during operation. The method may include guiding the cable along the worksite via at least one cable guide and determining a position of the at least one cable guide relative to the worksite. The method may also include periodically detecting a position of the cable within the worksite and generating a position data set in response thereto. The method may also include determining a cable avoidance region based on the position data set.

DETAILED DESCRIPTION

Figure 1:
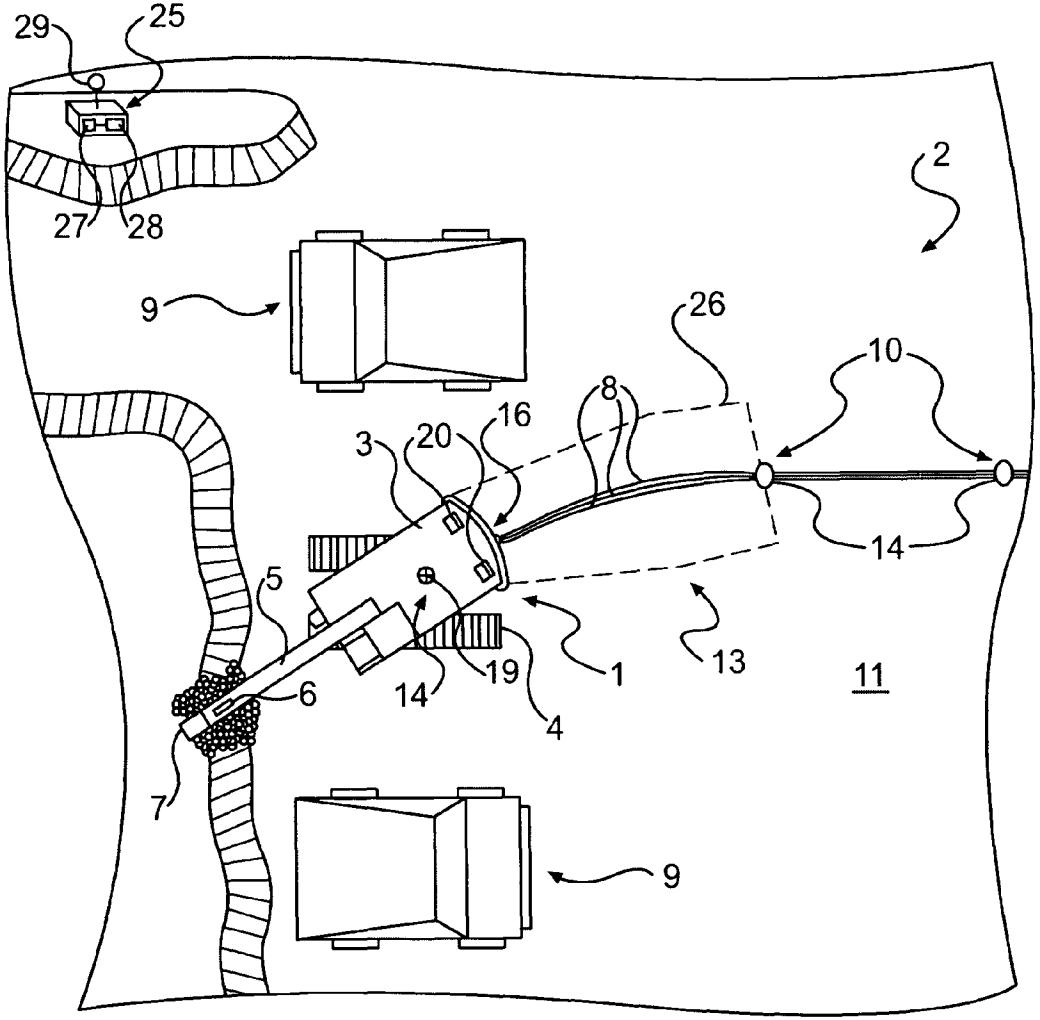
FIG. 1 is a diagrammatic illustration of an avoidance system for an earthmoving machine operating at a worksite according to an exemplary disclosed embodiment.

A diagrammatic illustration of a mobile earthmoving machine 1 operating at a worksite 2 is shown in FIG. 1. Machine 1 may be any type of machine capable of excavating earth, such as, an excavator, an electric mining shovel, drilling machine or the like. Machine 1 may be self-propelled and include a rotatable car body 3 connected to an undercarriage 4. Machine 1 may also include a boom 5, a stick 6, and an earthmoving tool 7. The boom 5 may be pivotally mounted on machine 1 by a boom pivot pin. Stick 6 may be pivotally connected to the free end of boom 5 at a stick pivot pin. Earthmoving tool 7 may be a power shovel, a bucket, or the like, and may be pivotally attached to stick 6 at a bucket pivot pin and configured to dig, scoop, and load material, such as ore, coal, or other minerals. A conduit, such as cable 8, may be a set of high voltage cables and may be connected to machine 1 from one or more large electric motors (not shown) on the rear of machine 1. Cable 8 may be configured to provide electricity from a central power source (not shown) to machine 1 so as to power the operation of machine 1 and earthmoving tool 7. Machine 1 may be configured to travel along worksite 2, such as, for example, an open-pit mine. Car body 3 may rotate so that earthmoving tool 7 may excavate and load material from various locations of worksite 2 along the path of rotation. Earthmoving tool 7 may be configured to unload material to worksite equipment, such as off-road vehicle 9, wherein the off-road vehicle 9 may transport material from worksite 2. Although off-road vehicle 9 is shown as an off-road mining truck, other types of mobile worksite equipment may be employed at worksite 2, for example, wheel loaders, track-type tractors, and the like.

An avoidance system 13 may be configured to track locations of cable 8 along worksite 2 during operation of machine 1. Avoidance system 13 may include reference markers, such as at least one cable guide 10. Cable guide 10 may be engaged with the worksite surface 11 and configured to guide cable 8 along a worksite surface 11 during operation of machine 1. In one embodiment shown in FIG. 2, cable guide 10 may include a supporting body 12 engaging worksite surface 11. In this particular embodiment, supporting body 12 may include an elongated member, such as stake 33, imbedded into worksite surface 11. Stake 33 may elevate cable guide 10 from surface 11 and may also be configured to fix and stabilize cable guide 10 against tension and movement from cable 8. Alternatively, supporting body 12 may include a base mounted on top of surface 11. The base may have sufficient counterweight to counteract tension and movement of cable 8 and support cable guide 10 during operation of machine 1.

Figure 2:
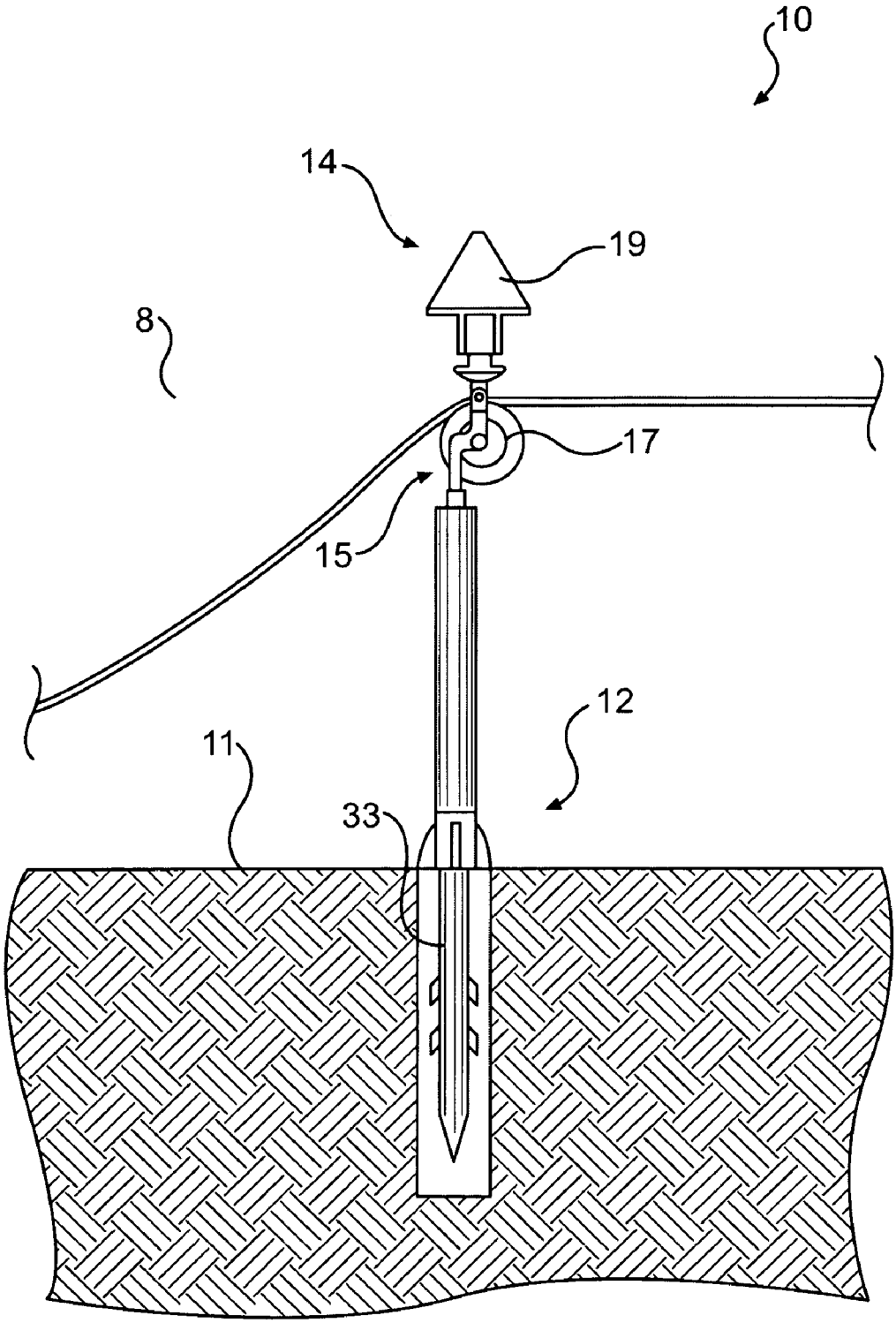
FIG. 2 is a diagrammatic illustration of a cable guide for an earthmoving machine according to an exemplary disclosed embodiment.

A guide member 15 may be mounted on supporting body 12 and configured to direct cable 8 in a fixed travel path in response to movement by machine 1. Cable 8 may be engaged with guide member 15, wherein the guide member 15 supports and elevates cable 8 a desired distance above surface 11. Supporting body 12 and guide member 15 may elevate cable 8 to a sufficient height so as to allow off-road vehicle 9 to travel between adjacent cable guides 10 and underneath cable 8. Portions of cable 8 behind machine 1 (i.e., between machine 1 and an adjacent cable guide 10) may be draped along worksite surface 11 and provided with slack so as to freely move in accordance with movement of machine 1. In this embodiment, guide member 15 may include at least one pulley 17, wherein cable 8 may be draped along pulley 17. Guide member 15 may be pivotally engaged with supporting body 12 so as to accommodate lateral movement of cable 8. Although one pulley 17 is illustrated in FIG. 2, it will be understood that the number of pulleys could be one or more than one and still fall within the scope of this disclosure. For example, cable 8 may be threaded between multiple opposing pulleys. Furthermore, expedients other than pulleys, such as rotatable spools, retractable wheels, roller bearings, or the like, may be employed. Any type of guide member configured to support cable 8 along worksite surface 11 and direct cable 8 along a fixed path may be employed.

A positioning system 14 may be associated with cable guide 10. As shown in FIG. 2, positioning system 14 may include an electronic marker 19 configured to transmit an electronic signal indicative of a position of cable guide 10. Electronic marker 19 may be, for example, a satellite positioning system, such as a global positioning system (GPS) configured to determine the GPS coordinates of cable guide 10. The location of the cable guide 10 may be determined relative to worksite 2 based on the GPS coordinates.

In the embodiment shown in FIG. 1, positioning system 14 may further be associated with earthmoving machine 1. An electronic marker 19 may be mounted on machine 1, for example, on the axis of rotation of car body 3 about under carriage 4. Although the electronic marker 19 may be mounted on the axis of rotation, it should be apparent that other mounting locations are possible, such as on the rear of machine 1 so as to rotate about the axis of rotation. As discussed above, electronic marker 19 may be, for example, a satellite positioning system, such as a global positioning system (GPS) configured to determine the GPS coordinates of machine 1. The location of the machine 1 may be determined relative to worksite 2 based on the GPS coordinates.

It should be appreciated that a variety of known types of electronic markers and receivers may be capable of transmitting and detecting a signal based on the locations of machine 1 and cable guide 10, and that any conventional type of electronic marker may be employed. For example, positioning system 14 may include a passive transponder configured to radiate an electromagnetic field. An appropriate receiver, such as a conventional transceiver, may be employed to detect and locate the transponder, and thus, the locations of machine 1 and cable guide 10. Additionally, azimuth sensors, scanning lasers, radio triangulation systems, microwave technology, or radar, alone or in combination with GPS technology, may also be employed to determine the locations of machine 1 and cable guide 10. Although the exemplary embodiments of the present disclosure have been described in terms of a positioning system for cable guides, it should also be appreciated that the disclosed positioning system is not restricted to cable guides and may also be associated with other reference markers within worksite 2, such as landmarks, poles, stakes, posts, or the like.

During operation, machine 1 may have the ability to reverse, go forward, rotate 360 degrees, and in general, maneuver freely. As machine 1, in particular car body 3, rotates to alternate loading of material and unloading into vehicle 9, or maneuvers along worksite 2, portions of cable 8 engaged between adjacent cable guides 10 may maintain a fixed, straight lined path along worksite surface 11. Other portions of cable 8 not supported by adjacent cable guides 10, for example, a section of cable 8 running immediately from the rear of machine 1, may change position and location in response to movement by machine 1.

Figure 3:
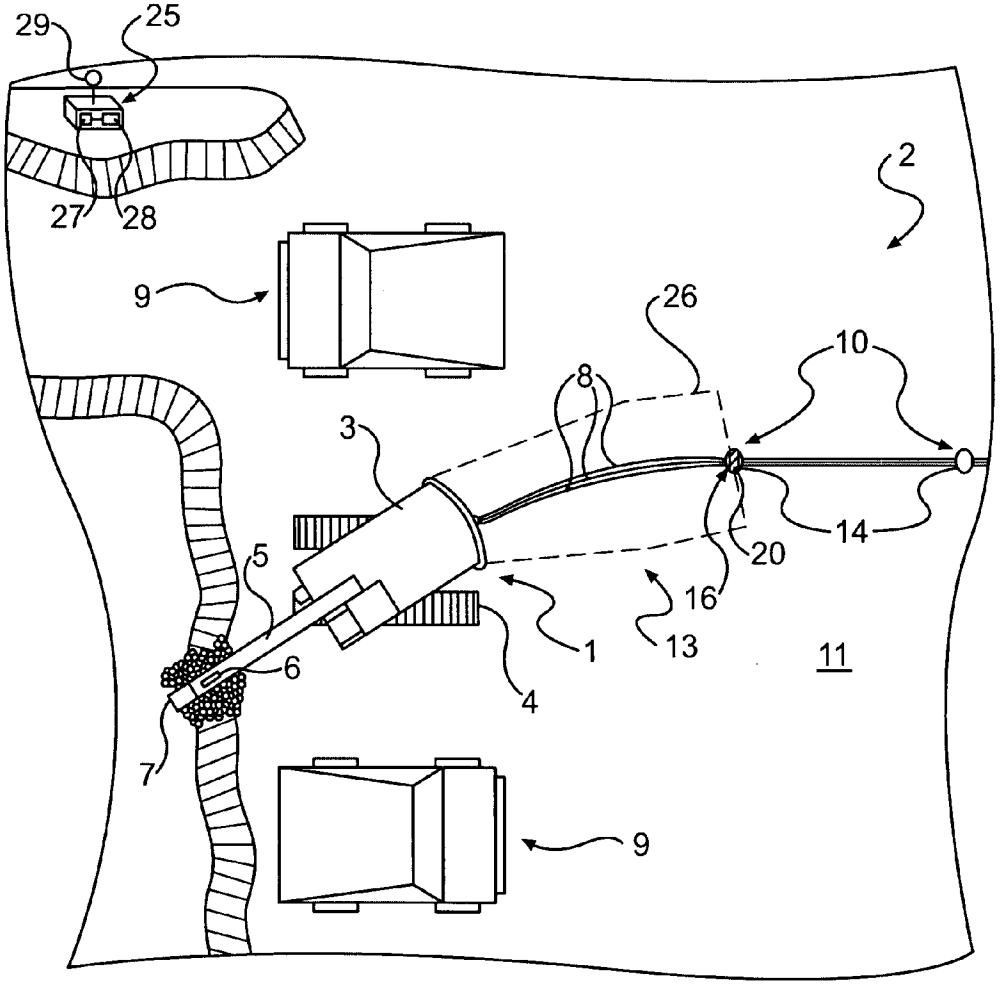
FIG. 3 is a diagrammatic illustration of another embodiment of an avoidance system for an earthmoving machine operating at a worksite according to an exemplary disclosed embodiment.
Figure 4:
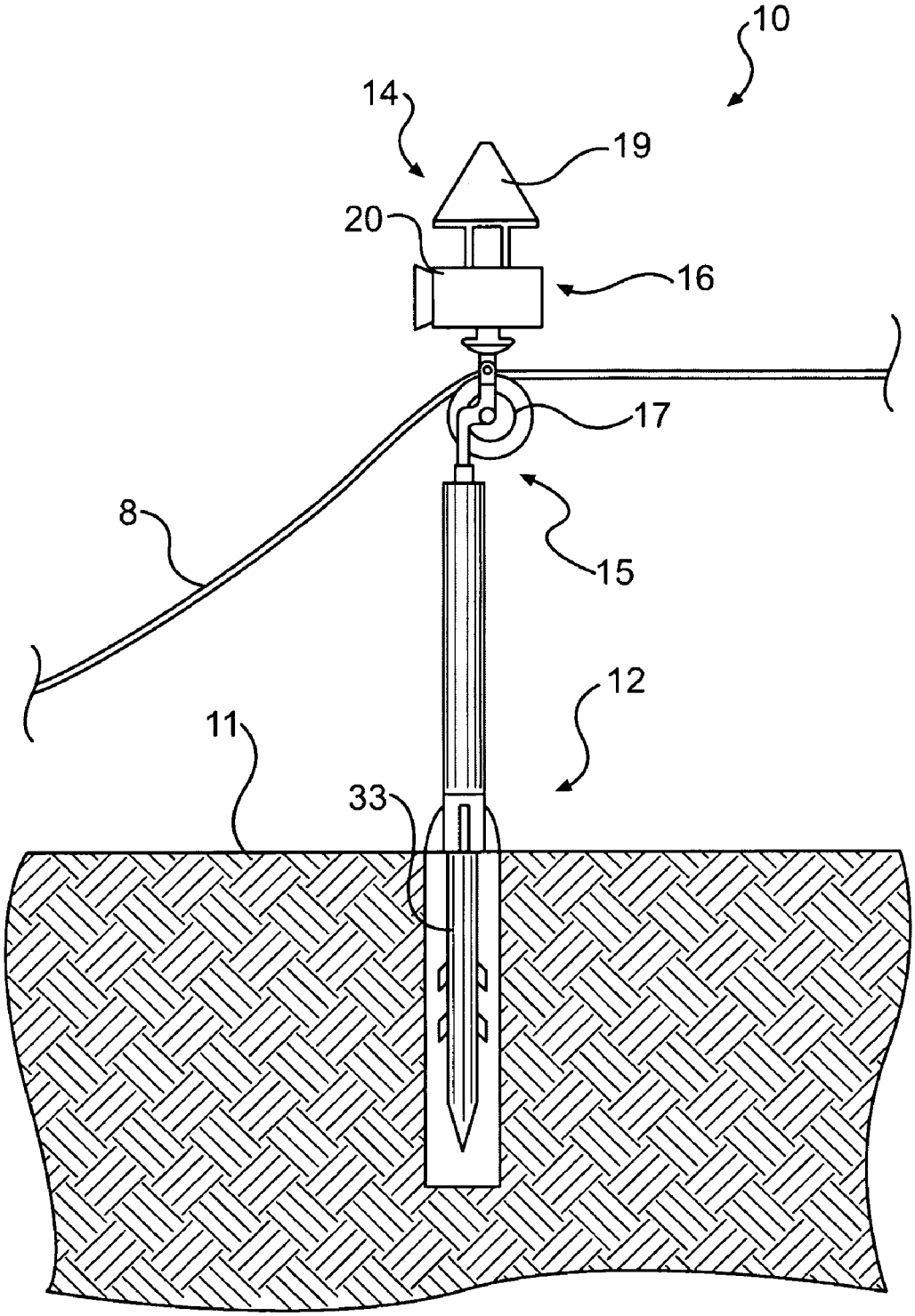
FIG. 4 is a diagrammatic illustration of another embodiment of a cable guide for an earthmoving machine according to an exemplary disclosed embodiment.

As shown in FIG. 1, a sensor system 16 may be mounted on machine 1 and configured to periodically detect a position of cable 8 within worksite 2. Sensor system 16 may, for example, detect a position of cable 8 every thirty seconds, two minutes, or any other calibrated time period. Alternatively, as shown in FIGS. 3 and 4, sensor system 16 may be mounted on cable guide 10 and may periodically detect the position of cable 8 within worksite 2 and also determine the location of machine 1 relative to cable guide 10. Sensor system 16 may be positioned on cable guide 10 so as to have a sufficient field of view to cover movement of machine 1.

Sensor system 16 may include at least one sensor 20 for detecting the movement and subsequent position changes of cable 8, and in the embodiments of FIGS. 3 and 4, the position changes of both cable 8 and machine 1. Sensor 20 may be, for example, a radar sensor, a scanning laser sensor, an ultrasonic sensor, an infrared sensor, or an optical sensor, such as a range-finding camera. In addition, sensor system 16 may include any combination of the above sensors or any other sensor capable of detecting the position and location of cable 8 and machine 1.

Figure 5:
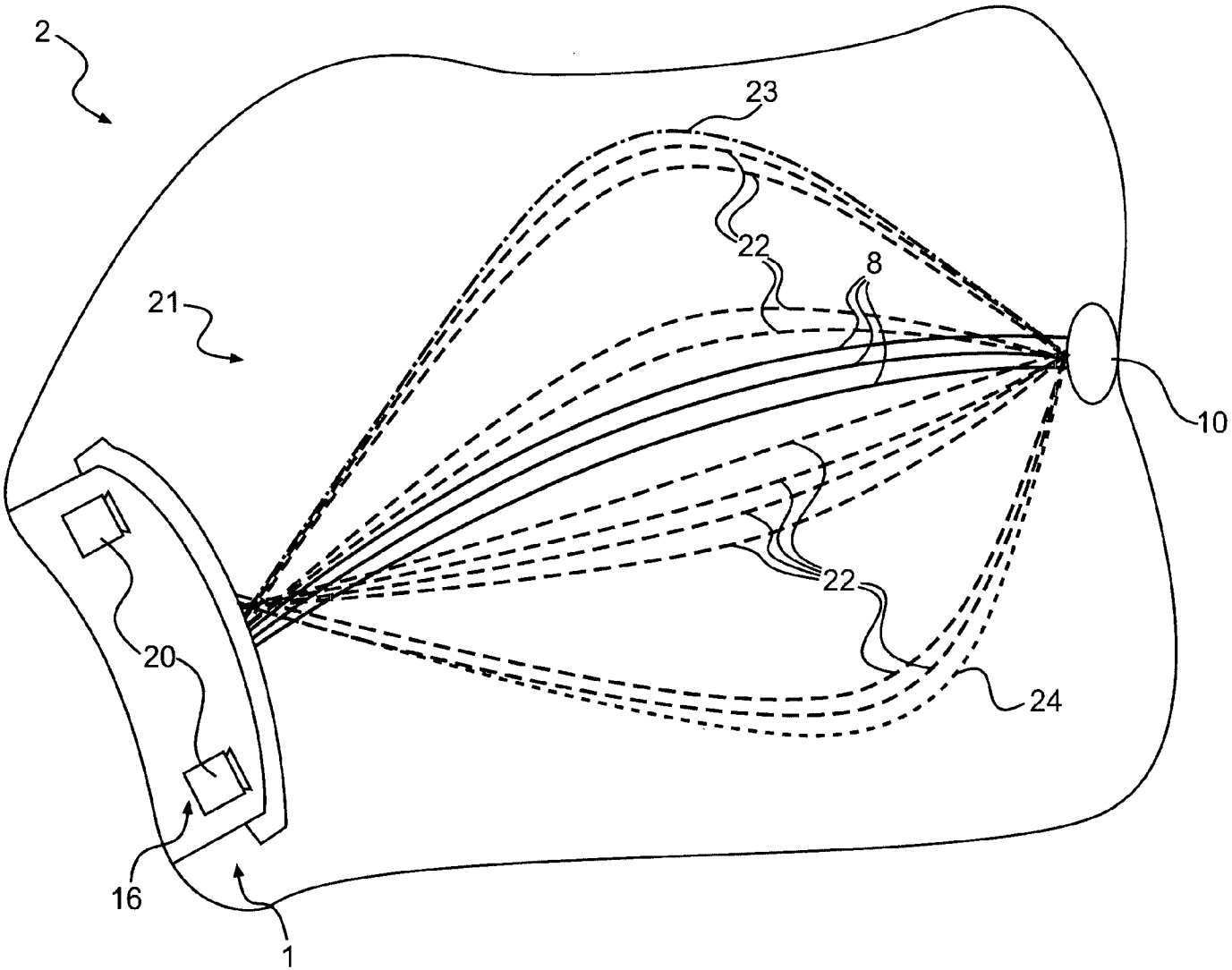
FIG. 5 is a diagrammatic illustration of various locations within a worksite area of a cable for an earthmoving machine during operation according to an exemplary disclosed embodiment.

As shown in FIG. 5, cable 8 may shift positions and locations within a loosely defined area 21 behind machine 1. Sensor system 16 may periodically scan area 21 and identify a range of cable positions 22 along worksite 2 during operation of machine 1. The range of cable positions 22 may include a first boundary position 23 and a second boundary position 24. First boundary position 23 and second boundary position 24 may be indicative of the extreme, outer positions of cable 8 relative to area 21 during operation of machine 1. Sensor system 16 may also be configured to generate a position data set based on the range of cable positions 22.

Although not shown in FIG. 5, it should be understood that sensor system 16 may be mounted on cable guide 10 (as shown in FIG. 3) to periodically scan area 21 and identify a range of cable positions 22 along worksite 2 during operation of machine 1.

As shown in the embodiments of FIG. 1 and FIG. 3, a controller 25 may be in communication with sensor system 16 and positioning system 14. Controller 25 may be located in a central office (not shown) overlooking worksite 2 and configured to receive the position signal of cable guide 10 and the position data set. A cable avoidance region 26 of worksite 2 may be determined by controller 25 based on the position data set. Controller 25 may confine area 21 to first boundary position 23 and second boundary position 24, mapping and outlining cable avoidance region 26 based on the confinement of area 21. Cable avoidance region 26 may be larger or smaller than shown in the exemplary embodiments of FIG. 1 and FIG. 3 depending on any number of factors such as, the length of cable 8, the amount of slack on cable 8, and the angular rotation of car body 3. The cable avoidance region 26 may be indicative of the likely location of cable 8 behind machine 1, and thus, an area within worksite 2 to avoid for an operator of off-road vehicle 9 or any other worksite equipment. Because position data of cable 8 may be periodically detected by sensor system 16, controller 25 may develop the cable avoidance region 26 based on cable position data history. Furthermore, since controller 25 does not determine the cable avoidance region 26 based upon live, streaming position data of cable 8, less bandwidth is consumed by controller 25. Controller 25 may include, for example, a processor 27, a memory 28, and a communications system 29 configured to receive the position signal of cable guide 10 and the position data set from sensor system 16, and deliver data indicative of the cable avoidance region 26 to vehicles 9 and other worksite equipment within worksite 2.

In the embodiment shown in FIG. 1, controller 25 may be configured to receive position signals of cable guide 10, machine 1, and other landmarks of worksite 2 and generate a position coordinate map based on the positions. The coordinate map may represent a coordinate system of the entire worksite 2, wherein cable guide 10, machine 1, and/or other landmarks represent reference points for locating cable 8.

Although the exemplary embodiments of the present disclosure have been described in terms of an avoidance system for electric cables for mobile earthmoving machines, it should be appreciated that the disclosed avoidance system is not restricted to electric cables for mobile earthmoving machines but may also be employed to track other conduits tethered from mobile earthmoving machines, such as conduits for delivering drilling mud, fluid, and the like. The disclosed avoidance system may also be employed in other applications that use long runs of cable, rope, or piping that may not be considered permanent infrastructure.

INDUSTRIAL APPLICABILITY

The disclosed avoidance system 13 may have applicability with conduits, such as electric cables 8 for a mobile earthmoving machine 1. For example, and as shown in FIG. 1 and FIG. 3, avoidance system 13 may serve to locate cable 8 engaged with and tethered from mobile earthmoving machine 1 along worksite 2 during operation. The disclosed avoidance system 13, cable 8, and a mobile earthmoving machine 1 may provide a mobile earthmoving machine system that enables haulage units, such as off-highway trucks, to locate and avoid contact with electric cables so as to prevent damage to the electric cables and to the haulage units.

During operation of machine 1, avoidance system 13 may track and determine the location of cable 8 by detecting position data of cable guide 10 and cable 8. The controller 25 may determine a cable avoidance region 26 based on the position data of the cable guide 10 and cable 8, and responsively deliver the region data to off-road vehicles 9 and any other worksite equipment within worksite 2.

Figure 6:
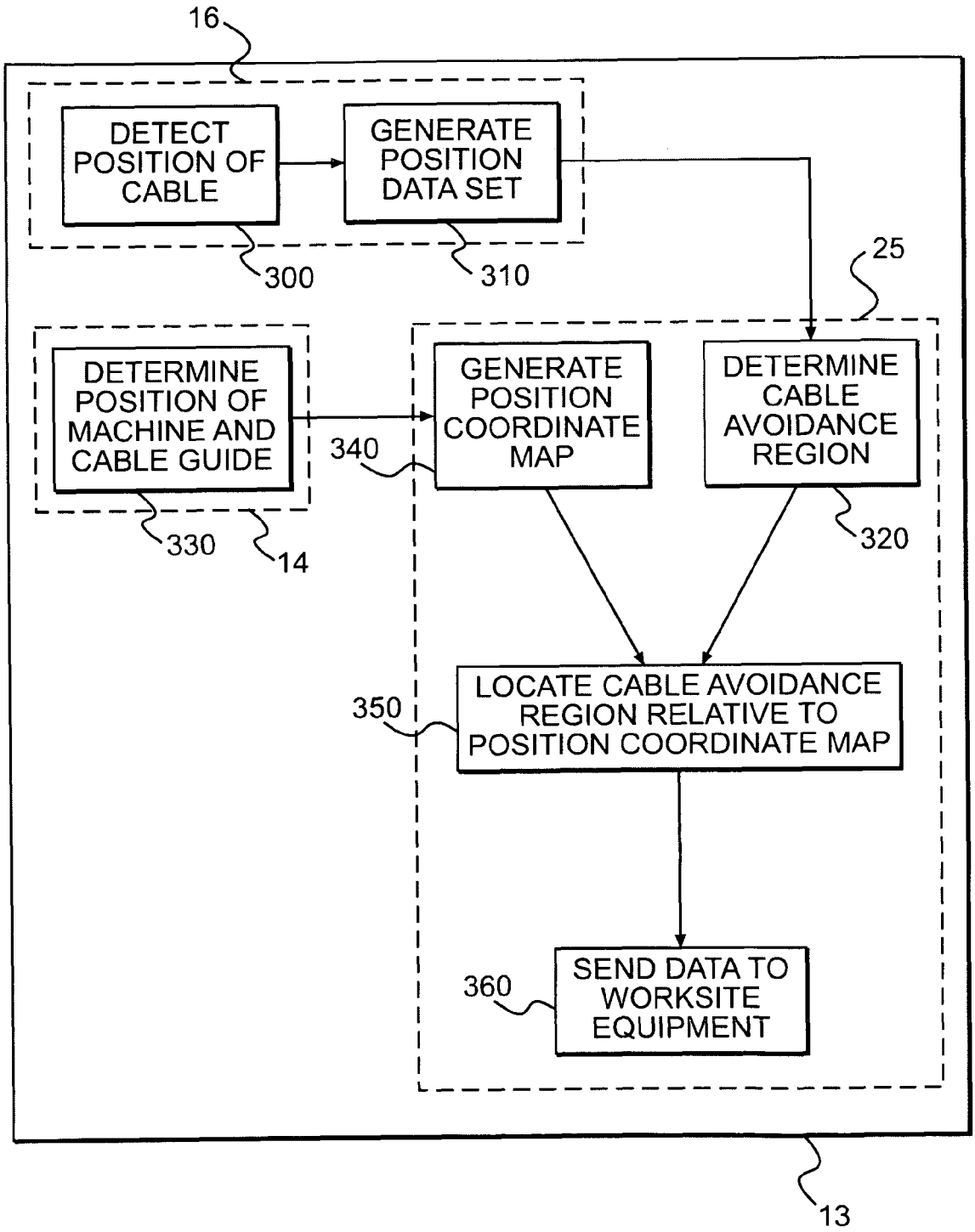
FIG. 6 is a flow chart illustrating the avoidance system logic according to an exemplary disclosed embodiment.

FIG. 6 is a block diagram illustrating how avoidance system 13 of FIG. 1 may determine the cable avoidance region 26 of worksite 2. Sensor system 16 mounted on machine 1 may periodically scan area 21 of worksite 2 behind machine 1 and detect positions of cable 8 during operation, box 300. Sensor system 16 may generate a position data set of the various positions 22 of cable 8, box 310, the position data set including first and second boundary positions 23, 24, and deliver the position data set to controller 25. The controller 25 may process the position data from sensor system 16 and determine a cable avoidance region 26. Controller 25 may confine area 21 to first boundary position 23 and second boundary position 24, mapping and outlining cable avoidance region 26 based on the confinement of area 21, box 320.

Position and location data of machine 1, cable guide 10, and any other landmarks within worksite 2 may be determined by positioning system 14 and delivered to controller 25, box 330. Controller 25 may generate a position coordinate map of worksite 2 based upon the position data from positioning system 14, box 340. Controller 25 may accurately locate and define the cable avoidance region 26 relative to the position coordinate map, box 350, and thus the entire worksite 2. The cable avoidance region data may be delivered to worksite equipment, such as off-road vehicle 9, in communication with controller 25, box 360. Thereby, an operator of vehicle 9 may determine a traveling path to avoid cable avoidance region 26, and thus, contact with cables 8.

Figure 7:
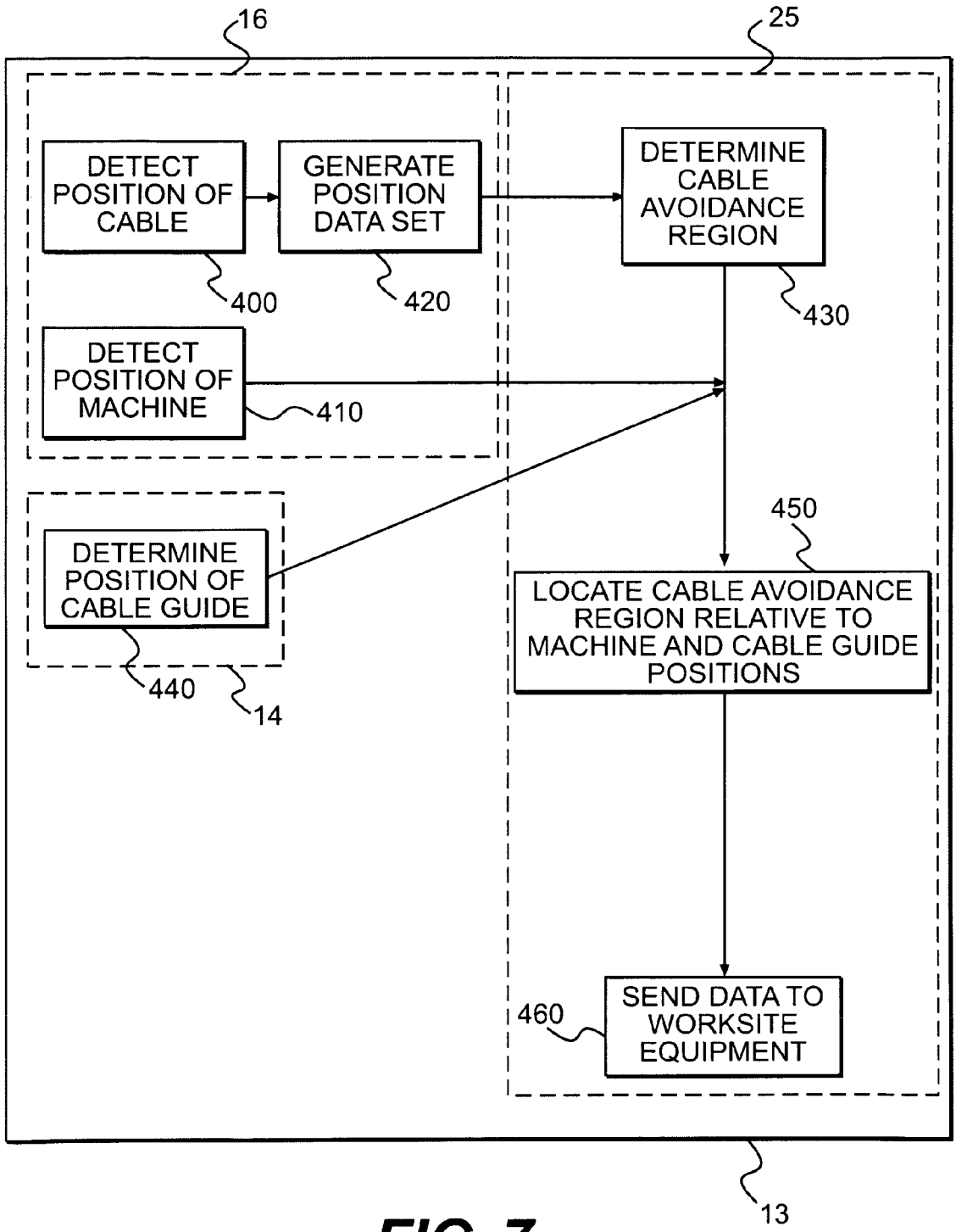
FIG. 7 is a flow chart illustrating another embodiment of the avoidance system logic according to an exemplary disclosed embodiment.

FIG. 7 is a block diagram illustrating how avoidance system 13 of FIG. 3 may determine the cable avoidance region 26 of worksite 2. Sensor system 16 mounted on cable guide 10 may periodically scan area 21 of worksite 2 behind machine 1 and detect positions 22 of cable 8 relative to cable guide 10 during operation, box 400. Sensor system 16 may also track and monitor the location of machine 1 relative to cable guide 10 and deliver position data of machine 1 to controller 25, box 410. A position data set of the various positions 22 of cable 8 may be generated by sensor system 16, box 420, the position data set including first and second boundary positions 23, 24, and delivered to controller 25. The controller 25 may process the position data from sensor system 16 and determine a cable avoidance region 26. Controller 25 may confine area 21 to first boundary position 23 and second boundary position 24, mapping and outlining cable avoidance region 26 based on the confinement of area 21, box 430.

Position and location data of cable guide 10 may be determined by positioning system 14 and delivered to controller 25, box 440. Controller 25 may process the position data of machine 1 and cable guide 10 and accurately locate and define the cable avoidance region 26 relative to the position of machine 1 and cable guide 10, box 450. The cable avoidance region data may be delivered to worksite equipment, such as off-road vehicle 9, in communication with controller 25, box 460. Thereby, an operator of vehicle 9 may determine a traveling path to avoid cable avoidance region 26, and thus, contact with cables 8.

Employing avoidance system 13 within worksite 2 may provide an accurate method to locate constantly moving obstacles, such as cable 8 of a mobile earthmoving machine 1. As cable 8 moves along worksite 2, avoidance system 13 may periodically scan the various positions 22 of cable 8 and develop a cable avoidance region 26 based on a historical compilation of cable 8 positions. Therefore, operators of worksite equipment may plan a traveling path to avoid the cable avoidance region 26, and thus, cable 8. Furthermore, because avoidance system 13 may periodically detect and compile the historical positions of cable 8 to develop the cable avoidance region 26, less bandwidth may be consumed by avoidance system 13 as compared to determining the cable avoidance region 26 based on constantly streaming position data of cable 8.

It will be apparent to those skilled in the art that various modifications and variations can be made to the avoidance system of the present disclosure without departing from the scope of the disclosure. Other embodiments will be apparent to those skilled in the art from consideration of the specification and practice of the embodiments disclosed herein. It is intended that the specification and examples be considered as exemplary only, with a true scope of the disclosure being indicated by the following claims.

What is claimed is:

1. An avoidance system configured to track a cable tethered from a mobile earthmoving machine along a worksite at or above a surface of the worksite during operation, the system comprising:

a sensor system configured to periodically detect a position of the cable along the worksite at or above a surface of the worksite and generate a position data set in response thereto; and a controller associated with the sensor system, the controller configured to determine a cable avoidance region based on the position data set, wherein the cable avoidance region represents a region for avoidance by other equipment or personnel.

2. The avoidance system of claim 1, further including at least one cable guide configured to guide the cable along the worksite.

3. The avoidance system of claim 2, further including a positioning system in communication with the controller and associated with the at least one cable guide, the positioning system configured to determine a position of the at least one cable guide relative to the worksite.

4. The avoidance system of claim 3, wherein the position data set includes a range of cable positions along the worksite during operation of the earthmoving machine, the range having a first boundary position and a second boundary position.

5. The avoidance system of claim 4, wherein the cable avoidance region includes and is within the first and second boundary positions.

6. The avoidance system of claim 5, wherein the sensor system is mounted on the earthmoving machine.

7. The avoidance system of claim 6, wherein the positioning system is further associated with the earthmoving machine, the positioning system configured to determine a position of the earthmoving machine relative to the worksite.

8. The avoidance system of claim 7, wherein the controller is configured to generate a position coordinate map based on the positions of the at least one cable guide and the earthmoving machine.

9. The avoidance system of claim 8, wherein the controller determines the cable avoidance region relative to the position coordinate map.

10. The avoidance system of claim 5, wherein the sensor system is mounted on the at least one cable guide.

11. The avoidance system of claim 10, wherein the sensor system is further configured to detect the position of the earthmoving machine relative to the at least one cable guide.

12. The avoidance system of claim 11, wherein the controller determines the cable avoidance region relative to the positions of the at least one cable guide and the earthmoving machine.

13. A method for tracking a cable tethered from a mobile earthmoving machine along a worksite during operation, the method comprising:

guiding the cable along the worksite via at least one cable guide;

determining a position of the at least one cable guide relative to the worksite;

periodically detecting a position of the cable within the worksite and generating a position data set in response thereto using a sensor system;

determining a cable avoidance region based on the position data set using a controller associated with the sensor system; and transmitting the cable avoidance region to a location external from the mobile earthmoving machine, wherein the cable avoidance region represents a region for avoidance by other equipment or personnel.

14. The method of claim 13, wherein generating the position data set further includes determining a range of cable positions along the worksite during operation, the range including a first boundary position and a second boundary position.

15. The method of claim 14, wherein determining the cable avoidance region further includes confining an area of the worksite to the first and second boundary positions.

16. The method of claim 15, further including determining a position of the earthmoving machine relative to the worksite.

17. The method of claim 16, further including generating a position coordinate map based on the positions of the at least one cable guide and the earthmoving machine.

18. The method of claim 17, further including determining the cable avoidance region relative to the position coordinate map.

19. A mobile earthmoving machine system, comprising:

at least one cable tethered from an earthmoving machine along a worksite at or above a surface of the worksite; and an avoidance system configured to track the at least one cable during operation, the system including:

a sensor system configured to periodically detect a position of the at least one cable along the worksite at or above a surface of the worksite and generate a position data set in response thereto; and a controller associated with the sensor system, the controller configured to determine a cable avoidance region based on the position data set, wherein the cable avoidance region represents a region for avoidance by other equipment or personnel.

20. The mobile earthmoving machine system of claim 19, further including at least one cable guide configured to guide the at least one cable along the worksite.

21. The mobile earthmoving machine system of claim 20, further including a positioning system in communication with the controller and associated with the at least one cable guide and the earthmoving machine, the positioning system configured to determine a position of the at least one cable guide and a position of the earthmoving machine relative to the worksite.

22. The mobile earthmoving machine system of claim 21, wherein the position data set includes a range of cable positions along the worksite during operation of the earthmoving machine, the range having a first boundary position and a second boundary position.

23. The mobile earthmoving machine system of claim 22, wherein the cable avoidance region includes and is within the first and second boundary positions.

24. The mobile earthmoving machine system of claim 23, wherein the controller is configured to generate a position coordinate map based on the positions of the at least one cable guide and the earthmoving machine and determine the cable avoidance region relative to the position coordinate map.

* * * * *